US009088855B2

(12) United States Patent
Goodwin

(10) Patent No.: US 9,088,855 B2
(45) **Date of Patent: *Jul. 21, 2015**

(54) VECTOR-SPACE METHODS FOR PRIMARY-AMBIENT DECOMPOSITION OF STEREO AUDIO SIGNALS

(75) Inventor: Michael M. Goodwin, Scotts Valley, CA (US)

(73) Assignee: Creative Technology Ltd, Singapore (SG)

( * ) Notice: Subject to any disclaimer, the term of this patent is extended or adjusted under 35 U.S.C. 154(b) by 1405 days.

This patent is subject to a terminal disclaimer.

(21) Appl. No.: 12/048,156

(22) Filed: Mar. 13, 2008

(65) Prior Publication Data

US 2008/0175394 A1 Jul. 24, 2008

Related U.S. Application Data

(63) Continuation-in-part of application No. 11/750,300, filed on May 17, 2007.

(60) Provisional application No. 60/894,650, filed on Mar. 13, 2007, provisional application No. 60/747,532, filed on May 17, 2006.

(51) Int. Cl.

| | |
|---|---|
| ***H04R 5/00*** | (2006.01) |
| ***H04S 3/00*** | (2006.01) |
| *G10L 19/008* | (2013.01) |

(52) U.S. Cl.
CPC ..... *H04S 3/008* (2013.01); *G10L 19/008* (2013.01)

(58) Field of Classification Search
CPC ..... H04R 5/00; H04B 1/00; G06F 17/20; G10I 19/00
USPC ..... 381/1, 17–23, 310, 119; 704/200, 500
See application file for complete search history.

(56) References Cited

U.S. PATENT DOCUMENTS

| | | | | |
|---|---|---|---|---|
| 5,632,005 | A * | 5/1997 | Davis et al. | 704/504 |
| 6,405,163 | B1 * | 6/2002 | Laroche | 704/205 |
| 7,257,231 | B1 * | 8/2007 | Avendano et al. | 381/99 |
| 7,567,845 | B1 * | 7/2009 | Avendano et al. | 700/94 |
| 7,965,848 | B2 * | 6/2011 | Villemoes et al. | 381/22 |
| 7,970,144 | B1 * | 6/2011 | Avendano et al. | 381/1 |
| 2007/0269063 | A1 * | 11/2007 | Goodwin et al. | 381/310 |

* cited by examiner

*Primary Examiner* — Disler Paul
(74) *Attorney, Agent, or Firm* — Russell Swerdon; Desmund Gean

(57) ABSTRACT

An audio signal is processed to determine primary and ambient components by transforming the signal into frequency-domain vectors, and decomposing the left and right channel vectors into ambient and primary components by orthogonal projection.

14 Claims, 13 Drawing Sheets

VECTOR-SPACE METHODS FOR PRIMARY-AMBIENT DECOMPOSITION OF STEREO AUDIO SIGNALS

CROSS-REFERENCE TO RELATED APPLICATIONS

This application is a continuation-in-part of U.S. patent application Ser. No. 11/750,300, which is entitled Spatial Audio Coding Based on Universal Spatial Cues, and filed on May 17, 2007 which claims priority to and the benefit of the disclosure of U.S. Provisional Patent Application Ser. No. 60/747,532, filed on May 17, 2006, and entitled "Spatial Audio Coding Based on Universal Spatial Cues", the specifications of which are incorporated herein by reference in their entirety. Further, this application claims priority to and the benefit of the disclosure of U.S. Provisional Patent Application Ser. No. 60/894,650, filed on Mar. 13, 2007, and entitled "Vector-Space Methods for Primary-Ambient Decomposition of Stereo Audio Signals", the entire specification of which is incorporated herein by reference in its entirety.

BACKGROUND OF THE INVENTION

1. Field of the Invention

The present invention relates to audio signal processing techniques. More particularly, the present invention relates to methods for decomposing audio signals into primary and ambient components.

2. Description of the Related Art

Primary-ambient decomposition algorithms separate the reverberation (and diffuse, unfocussed sources) from the primary coherent sources in a stereo or multichannel audio signal. This is useful for audio enhancement (such as increasing or decreasing the "liveliness" of a track), upmix (for example, where the ambience information is used to generate synthetic surround signals), and spatial audio coding (where different methods are needed for primary and ambient signal content).

Current methods determine ambience components for each audio channel by applying a real-valued multiplier to the original channel signal, such that the resulting primary and ambient components for each channel are in phase. Unfortunately, these techniques sometimes lead to artifacts in the audio reproduction. These artifacts include the "leakage" of primary components into the ambience, etc. What is desired is an improved primary-ambient decomposition technique.

SUMMARY OF THE INVENTION

The invention describes techniques that can be used to avoid such artifacts. The invention provides new methods for decomposing a stereo audio signal or a multichannel audio signal into primary and ambient components. Post-processing methods for improving the decomposition are also described.

The present invention provides methods for separating stereo audio signals into primary and ambient components. According to several embodiments, a vector-space primary-ambient decomposition is performed. The primary and ambient components are derived such that the sum of the primary and ambient components equals the original signal and various desired orthogonality conditions are satisfied between the components. In preferred embodiments, the input audio signals are each filtered into subbands; these subband signals are then treated as vectors and are decomposed into primary and ambient components using vector-space methods. One advantage of theses embodiments is that less tuning of algorithm parameters is required than in previously described methods.

Embodiments of the current invention can operate directly on the time-domain audio signals. In preferred embodiments, however, the incoming stereo audio signal is initially converted from a time-domain representation to a frequency-domain or subband representation. In one method for converting to the frequency domain, commonly referred to as the short-time Fourier transform (STFT), each channel of the stereo audio signal is windowed to generate frames or segments of sound and a Fourier Transform is performed on the windowed signal frames to generate a frequency-domain representation of the signal content in each frame; the window function removes from the current processing focus all but a short-time interval of the time-domain signal. The frames are spaced at a regular offset known as the hop size. The hop size determines the overlap between the frames. The application of the STFT results in the distribution of the transformed signal over a plurality of frequency bins or subbands. For each signal window or frame, each bin contains magnitude and phase values for the channel signal in that frame; a time sequence for each particular bin, corresponding to a sequence of prior signal windows, is analyzed to allocate the respective bin's signal content for the current time to either primary or ambient components. The allocation of primary and ambient components is based on vector-space operations. An inverse transform is applied to the resulting primary and ambient signal content to generate the respective primary and ambience time-domain signals.

In several embodiments, the respective channel signals are decomposed into primary and ambient components in order to satisfy selected orthogonality constraints. The audio signals and signal components are treated as vectors to enable the application of vector and matrix mathematics and to facilitate the use of diagrams to illustrate the operation of the various embodiments.

In a first embodiment, a key constraint is that the left (L) channel signal cannot predict the ambience in the right (R) channel, and vice versa. Thus, the ambience for the R channel is that component of the R channel signal which is orthogonal to the L channel. The signals are thus decomposed into ambient and primary components by cross-channel orthogonal projection. That is, projecting a given channel signal (vector) onto the other channel signal (vector) yields the primary component for the given channel; for example, the left channel signal is projected onto the right to determine the left primary component. The ambience is found as the projection residual, which is orthogonal by construction to the corresponding primary component determined by cross-channel projection. In this way, the primary and ambient components determined for a given channel are orthogonal. However, the ambient components in the respective channels are not mutually orthogonal. Furthermore, the primary components in the respective channels are not fully correlated; that is, they are not in the same signal-space direction.

According to a second embodiment, the decomposition involves carrying out the cross-channel orthogonal projection to derive an initial primary-ambient decomposition and subsequently scaling the respective channel ambient components equally so as to derive modified ambience components and modified primary components. The scaling is preferably selected to result in the modified primary components for the two channels being collinear in signal space. A tradeoff occurs in the degree of orthogonality between the ambience and primary components in the same channel and across channels.

According to a third embodiment the decomposition involves carrying out the cross-channel orthogonal projection to derive an initial primary-ambient decomposition and subsequently scaling the respective ambience components such that the scaled ambience for each channel is equal. This variation also allows the resulting modified primary components to be collinear with some tradeoffs in same channel and cross-channel orthogonality.

According to a fourth embodiment the decomposition involves carrying out the cross-channel orthogonal projection to derive an initial primary-ambient decomposition and subsequently scaling the respective ambience components such that the resulting modified primary components are collinear and the total energy of the modified ambience components is minimized.

According to a fifth embodiment, a principal components analysis (PCA), which can be equivalently referred to as "principal component analysis" (where "component" is singular), having a novel closed-form solution is provided such that iteration is not required to generate the primary and ambient components. A principal direction for the primary component is established preferably by first determining the dominant eigenvalue of the channel signal's correlation matrix, and then identifying the corresponding eigenvector as the principal direction. This principal direction vector is found as a weighted average of the right and left channel vectors. The primary components are found as orthogonal projections onto the principal direction vector, and the ambience components are found as the corresponding projection residuals. The resulting primary components are fully correlated (collinear in signal space). The resulting ambience components are also collinear and are not orthogonal across the channels.

These and other features and advantages of the present invention are described below with reference to the drawings.

DETAILED DESCRIPTION OF PREFERRED EMBODIMENTS

Figure 1:
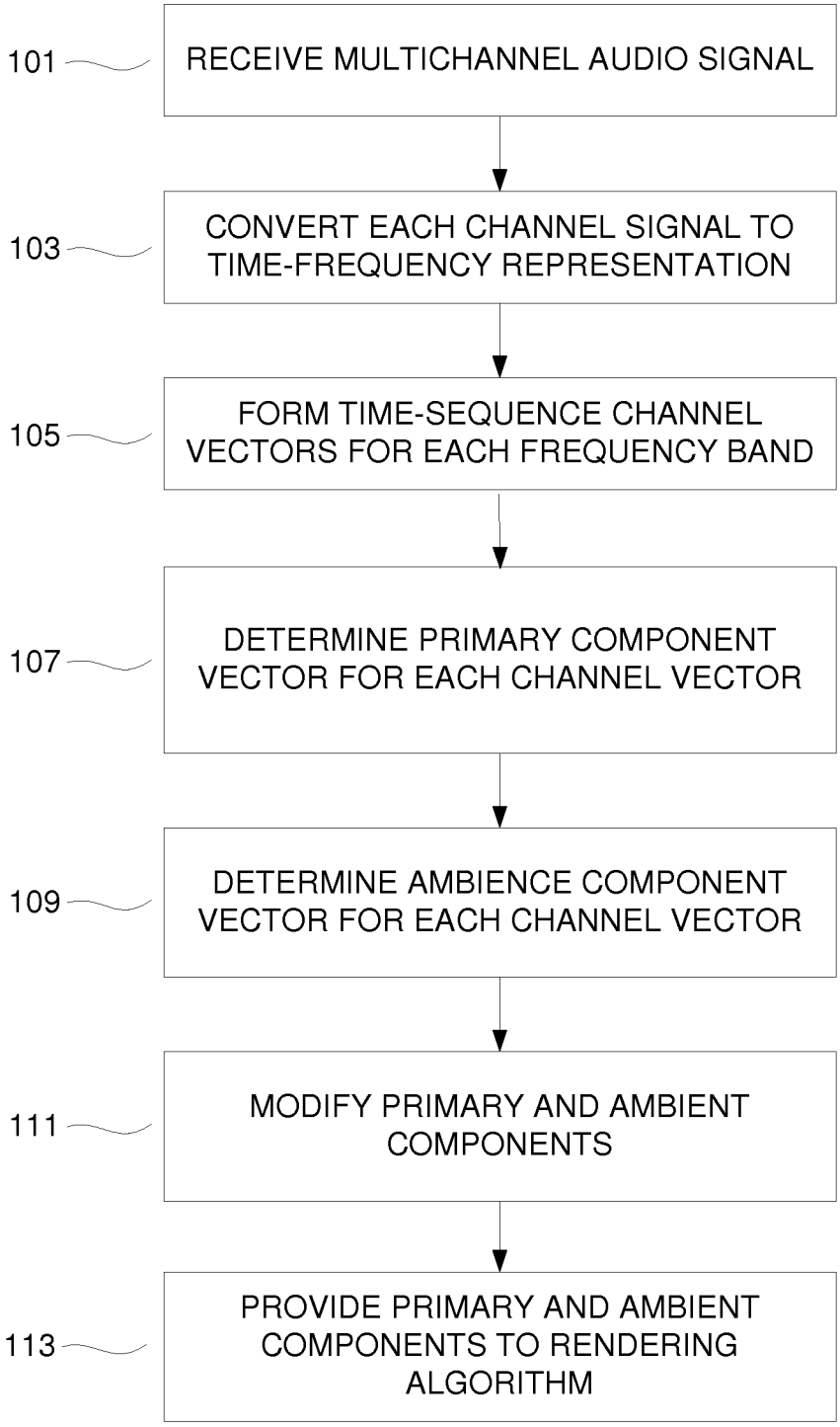
FIG. 1 is a flow chart of a method for primary-ambient decomposition and post-processing in accordance with embodiments of the present invention.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

The present invention provides improved primary-ambient decomposition of stereo audio signals or multichannel signals. The proposed methods provide more effective primary-ambient decomposition than previous conventional approaches.

The present invention can be used in many ways to process audio signals. The main goal is to separate a mixture of music, for example a 2-channel (stereo) signal, into primary and ambient components. Ambient components refer to natural background audio representative of the recording environment. For example, vocals may constitute primary signals.

Primary-ambient decomposition of audio signals is useful for stereo-to-multichannel upmix. The stereo loudspeaker reproduction format consists of front left and front right loudspeakers, whereas standard multichannel formats also include a front center and multiple surround and rear channels; stereo-to-multichannel upmix refers to any process by which signal content for these additional channels for a multichannel reproduction is generated from an input stereo signal. Generally, ambient components are used in stereo-to-multichannel upmix to synthesize surround signals which will result in an increased sense of envelopment for the listener. Primary components are typically used to generate center-channel content to stabilize the frontal audio image and enlarge the listening sweet spot. One approach for center-channel synthesis is to identify only that signal content in the original left and right channels that is center-panned (i.e. equally weighted in the two input channels and intended to be heard as originating from between the two speakers, as is typical for vocals in music tracks), to extract that content from the left and right channels, and then redirect it to the center channel; this approach is referred to as center-channel extraction. Another approach is to identify the panning directions for all of the content in the two input channels, and to reroute the content based on its panning direction so that is rendered by the closest pair of loudspeakers: content panned toward the left in the original stereo is rendered in the multichannel setup using the front left and front center loudspeakers; content originally panned toward the right is rendered in the multichannel setup using the front right and the front center loudspeakers (and content originally panned to the center is rendered using the center loudspeaker); this approach is referred to as pairwise panning.

According to embodiments of the invention, vector-space methods are used to decompose a stereo or multichannel audio signal into primary and ambient components. Transformation techniques are used to convert the time-domain signal into frequency-domain representations. Vectors based on the time history of individual subband signals are then used for either a vector-space cross-channel projection or a principal component analysis. The new methods differ from the prior art in part based on the number of analysis procedures. In the prior art, extractions of primary and ambient components had been performed with separate analysis procedures. A further distinction is that the vector-space approaches are essentially automatic relative to the prior art methods, requiring the tuning only of a time constant for an inner product computation.

The vector-space methods in the first four embodiments involve cross-channel projection. The vector-space methods in the fifth embodiment involve determination of a principal direction vector and projection onto that vector. In these various embodiments, the channel signals are decomposed into primary and ambient components in order to satisfy selected signal-space orthogonality constraints and conditions; for the purpose of this invention, the terms "signal-space" and "vector-space" can be taken as interchangeable in that the signals in question are treated as vectors.

The primary-ambient decomposition is based on selecting signal-space axes for the primary and ambient components based on various orthogonality constraints. Generally, a primary axis is first selected for each channel and we then project the vector corresponding to each channel onto the established axis. In several embodiments, the ambience is computed as the residual of this projection; the ambience axis for a given channel's decomposition is then orthogonal to the primary axis. In different embodiments, the method used to establish the axes for the unit vectors produce different results. For example, in a first embodiment incorporating cross-channel projection, orthogonal decomposition is used. The first channel is projected onto the opposite second channel. As a result, the first (left) channel is decomposed into a primary signal ($P_L$) and an orthogonal ambient left signal ($A_L$). That is, the left channel signal is the vector sum of the primary left ($P_L$) and ambient left ($A_L$) vectors.

In accordance with a second embodiment incorporating cross-channel projection, scaling is performed on the ambience with equal gains (attenuation) in each channel. The primary components in both channels are correspondingly modified such that the primary-ambient sum still equals the original signal. The ambience gains are selected so as to yield a new primary-ambient decomposition wherein the primary components are collinear in signal space.

In accordance with a third embodiment incorporating cross-channel projection, scaling is performed on the ambience components with gains selected such that the new primary component of the left signal and the new primary component of the right signal are collinear and the new ambient components have equal energy in the respective channels.

In accordance with a fourth embodiment incorporating cross-channel projection, scaling is performed on the ambience components with gains selected such that the new primary components of the left and right channel signals are collinear in signal space and the total energy of the resulting new ambience components is minimized. This approach tends to steer most of the signal content to a panned primary vector by minimizing the total energy that is not captured as a primary component.

In accordance with a fifth embodiment, the decomposition is based on using principal component analysis (PCA) to first find the optimal primary component. PCA identifies the dominant dimensions in multidimensional datasets, enabling reduction to fewer dimensions by parsing out dimensions with low energy. In the context of this embodiment of the current invention, the principal vector or direction determined by PCA is identified as the primary component signal-space direction; the PCA analysis finds the principal vector which best corresponds to the multichannel content, that is, it determines a primary-ambient decomposition with the least total ambience energy. The primary component for each channel is computed as the projection of the channel vector onto the principal vector, and the ambience vector for each channel is computed as the projection residual.

In one implementation, only the eigenvector of the correlation matrix with the largest eigenvalue is used for the PCA decomposition. In accordance with this embodiment, the primary axis is selected as corresponding to the dominant eigenvector derived from the principal component analysis.

In accordance with a first through fifth embodiment, a vector-space primary-ambient decomposition is performed. The primary and ambient components are estimated in a primary-ambient decomposition such that the sum of the primary and ambient components equals the original signal. The audio signal subbands are treated as vectors in time and these are decomposed into primary and ambient component vectors.

We present methods to separate stereo audio signals into primary and ambient components; the PCA-based methods are readily extensible to multichannel primary-ambient separation. Primary-ambient decomposition is useful for a number of applications including (1) Upmix: use of ambient components for synthetic surround generation; (2) Upmix: use of primary center-panned components for center-channel generation; or, alternately, the use of all extracted primary components for pairwise panning or generalized upmix; (3) Surround enhancement: modification of ambient and/or primary components for improved/customized rendering, such as increasing the ambience in both channels to achieve a widening or "enlivening" effect; (4) Headphone listening: enabling different virtualization and/or modification of primary and ambient components, e.g. for improved externalization; (5) Spatial coding/decoding: separation of primary and ambient components improves spatial analysis/synthesis and matrix decode; and (6) Karaoke: removal of primary voice components for karaoke with arbitrary music.

A distinction between primary and ambient components is used in a number of audio processing algorithms. The extraction of primary panned components from audio signals (based on methods other than vector-space decomposition) has been used for karaoke, upmix, and remixing applications. The extraction of ambience from audio signals has been used for upmix and enhancement. In previous upmix methods wherein primary and ambient components are both estimated, these extractions are done with separate analysis procedures. In the current invention, the primary and ambient components are estimated by the same procedure; in addition to the novel vector-space analysis methods, a further distinction of the work described here is that the primary and ambient components are estimated in the context of a primary-ambient decomposition wherein the sum of the primary and ambient components equals the original signal. Yet another distinction from previous methods is that less sound design, i.e. less tuning of algorithm parameters, is required in the proposed methods; the only key parameter to be tuned is the time constant for the computation of inner products, i.e. correlations between vectors, so the vector-space methods are essentially automatic relative to prior approaches. In addition to upmix, separate treatment of primary and ambient components has been described for spatial impulse response rendering and spatial audio coding. The present invention provides improved methods for estimation of primary and ambient components for use in any applications where separate treatment of primary and ambient components is desired.

Mathematical Foundations

The following equations define the relationships between the parameters used in the following analysis methods:

$$r_{LR}=\vec{X}_L^H\vec{X}_R \text{ (correlation)}$$

$$r_{LL}=\vec{X}_L^H\vec{X}_L \text{ (autocorrelation)}$$

$$r_{RR}=\vec{X}_R^H\vec{X}_R \text{ (autocorrelation)}$$

$r_{LR}(t)=\lambda r_{LR}(t-1)+(1-\lambda)X_L(t)^*X_R(t)$ (running correlation, where $X_i(t)$ is the new sample at time t of the vector $\vec{X}_i$)

$$\phi_{LR}=\frac{r_{LR}}{(r_{LL}r_{RR})^{1/2}} \text{ (correlation coefficient)}$$

(correlation coefficient)

$$\left(\frac{\vec{X}_R^H\vec{X}_L}{\vec{X}_R^H\vec{X}_R}\right)\vec{X}_R=\left(\frac{r_{LR}^*}{r_{RR}}\right)\vec{X}_R=\text{projection of } \vec{X}_L \text{ onto } \vec{X}_R$$

$$\left(\frac{\vec{X}_L^H\vec{X}_R}{\vec{X}_L^H\vec{X}_L}\right)\vec{X}_L=\left(\frac{r_{LR}}{r_{LL}}\right)\vec{X}_L=\text{projection of } \vec{X}_R \text{ onto } \vec{X}_L$$

When a signal is transformed (e.g. by the STFT), there is a component $X_i[k,m]$ or each transform index k and time index m; in the STFT case, the index m indicates the time location of the window to which the Fourier transform was applied. For each given k, the transform is treated as a vector in time, i.e. samples of $X_i[k,m]$ at a given k and a range of m values are concatenated into a vector representation. In principle, any signal decomposition or time-frequency transformation could be used to generate these subband vectors. It is preferred that a time-frequency representation is used for the subband vectors. However, the scope of the invention is not so limited. Other forms of signal representation may be used including but not limited to time-domain representations of the signals. The vector length is a design parameter: the vectors could be instantaneous values (scalars), in which case the vector magnitude corresponds to the absolute value of a sample; or, the vectors could have a static or dynamic length. Alternately, the vectors and vector statistics could be formed by recursion, in which case the treatment of the signals as vectors is not explicit in the methods: in this case, signal vectors are not explicitly assembled by concatenation of successive samples; but rather (for each channel in each subband) only the current input sample is required (in conjunction with the recursively computed correlations) to compute the current output sample. Those skilled in the relevant arts will recognize that several embodiments of the present invention can be implemented in this way without explicit formation of signal vectors; these implementations are within the scope of the invention in that vector-space methods are implicitly used. It should be noted that a recursive formulation, as in the running correlation $r_{LR}$ above, is useful for efficient inner product calculations such as those needed to compute correlations and is furthermore useful for enabling implementations that do not require explicit formation of signal vectors. Also, it should be noted that orthogonality of vectors in signal space is equivalent to the corresponding time sequences being uncorrelated.

FIG. 1 is a flow diagram depicting primary-ambient decomposition based on vector-space methods in accordance with several embodiments of the present invention. The process begins in step 101 where a multichannel audio signal is received. In step 103, each channel signal is converted into a time-frequency representation, in a preferred embodiment using the STFT. Although the STFT is preferred, the invention is not limited in this regard. That is, the use of other time-frequency transformations and representations is included within the scope of the invention. In step 105, a channel signal vector is formed for each channel and each frequency band in the time-frequency representation by concatenating successive samples of the subband channel signals into vectors. In this way, a channel signal vector represents the evolution in time of the channel signal within a frequency band or subband of the time-frequency representation. In step 107, a primary component vector is determined for each channel vector using vector-space methods such as orthogonal projection or principal component analysis. In step 109, the ambience component vector is determined for each channel vector as the difference between the channel vector and the primary component vector, such that the sum of the primary component vector (determined in step 107) and the ambience component vector (determined in step 109) is equal to the original channel vector. Mathematically, this decomposition can be expressed as $$\vec{X}_{i\,[k,m]}=\vec{P}_{i\,[k,m]}+\vec{A}_{i\,[k,m]}$$

where i is a channel index, k is a frequency index, m is a time index, $\vec{X}_i$ [k,m] is the input channel vector, $\vec{P}_i$ [k,m] is the primary component vector, and $\vec{A}_i$ [k,m] is the ambience component vector. In step 111, the primary and/or ambience components of the decomposition are optionally modified; according to several embodiments, these modifications correspond to gains applied to the primary and ambient components. In step 113, the potentially modified components are provided to a rendering algorithm which includes a conversion of the frequency-domain components into time-domain signals. In one embodiment, the modified components are provided to a rendering algorithm without any particularity as to the type of rendering algorithm. That is, in this embodiment, the scope of the invention is intended to cooperate with any suitable rendering algorithm. In some cases, the rendering might just re-add the modified primary and ambient components for playback. In others, it might distribute the components differently to different playback channels.

Throughout the specification, the channel index i will be designated as either L (for left) or R (for right) when the input audio signals in question are two-channel or stereo signals. For such two-channel signals, the primary-ambient signal model can be written as $$\vec{X}_L[k,m]=\vec{P}_L[k,m]+\vec{A}_L[k,m]$$

$$\vec{X}_R[k,m]=\vec{P}_R[k,m]+\vec{A}_R[k,m].$$

Furthermore, the primary and ambient components can equivalently be expressed as weighted versions of unit vectors such that the signal model can be rewritten as $$\vec{X}_L[k,m]=c_{PL}\vec{v}_{L\,L}[k,m]+c_{AL}\vec{a}_{L\,L}[k,m]$$

$$\vec{X}_R[k,m]=c_{PR}\vec{v}_{R\,R}[k,m]+c_{AR}\vec{a}_{R\,R}[k,m]$$

where $\vec{v}_{L\,L}$ and $\vec{v}_{R\,R}$ are unit vectors for the respective primary components, and $\vec{a}_L$ and $\vec{a}_R$ are unit vectors for the ambience components. Those of skill in the art will understand that the various embodiments of the present invention involve different choices for these unit component vectors.

In a primary-ambient decomposition derived according to the signal model $\vec{X}_i[k,m]=\vec{P}_i[k,m]+\vec{A}_i[k,m]$, it is desirable that various orthogonality and correlation conditions be satisfied. Ideally, the ambience components identified for different channels should be orthogonal in signal space, i.e. uncorrelated. Ideally, the primary components identified for different channels should be collinear in signal space, i.e. fully correlated (except in the case of a hard-panned source in a single channel). And ideally, the primary and ambience components identified within a given channel should be orthogonal in signal space, i.e. uncorrelated. Those skilled in the arts will understand that various primary-ambient decomposition methods necessarily involve tradeoffs between the degrees to which each of these conditions are satisfied. The subsequent description of the embodiments of the present invention includes discussions of these and related orthogonality and correlation conditions.

Primary-Ambient Decomposition by Cross-Channel Projection

In accordance with a first through fourth embodiment, primary-ambient separation is performed using cross-channel projection. In the vector-space or signal-space approaches disclosed in the current invention, the basic idea is to decompose the channel signals into primary and ambient components in signal space in order to satisfy some target signal-space orthogonality constraints. The key notion in the cross-channel projection decomposition methods (in the first through fourth embodiments) is that the signal in a given channel cannot predict the ambience in a different channel. Thus, the ambience in the right channel is that part of the right channel signal which is orthogonal to the left channel, and vice versa. (Hard-panned sources, i.e. primary sources present only in one channel, constitute an exception to this rule and call for independent treatment.) The signals are thus decomposed into ambient and primary components by cross-channel orthogonal projection.

Figure 2:
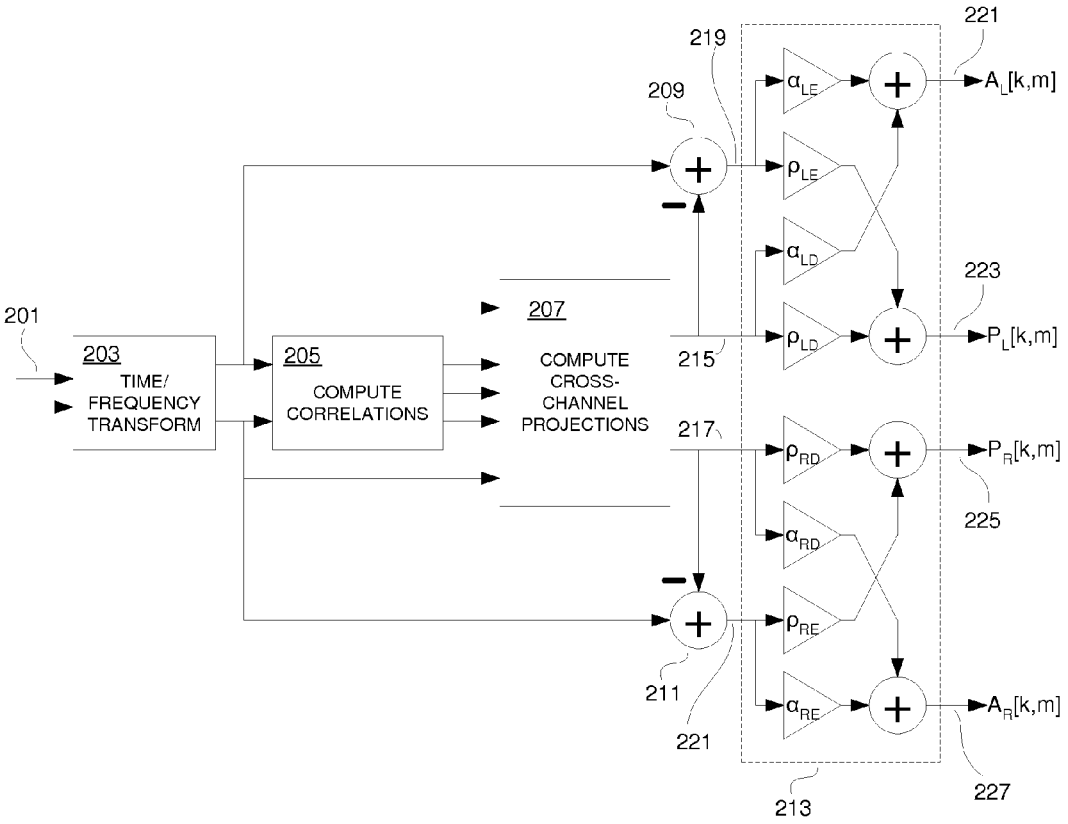
FIG. 2 is a block diagram illustrating a method of decomposing a stereo audio signal into primary and ambient components in accordance with embodiments of the present invention.

FIG. 2 provides a block diagram of the embodiments incorporating cross-channel projection. In block 203, the input audio channels 201 are transformed to a time-frequency representation, e.g. via the STFT. This can be expressed using the notation $x_i[n]\rightarrow X_i[k,m]$. In block 205, the cross-correlations and auto-correlations are computed for each frequency bin signal or subband signal, i.e. for each k; these quantities are denoted by $r_{LR}[k,m]$ for the cross-correlation between the left and right channels, $r_{LL}[k,m]$ for the autocorrelation of the left-channel signal, and $r_{RR}[k,m]$ for the autocorrelation of the right-channel signal. Within this block, the time sequences $X_L[k,m]$ and $X_R[k,m]$ are treated as vectors in the computation of the correlations. The correlation values computed in block 205 are provided as inputs to block 207, which determines the cross-channel projections according to $$\vec{D}_L[k,m]=\frac{r^*_{LR}[k,m]}{r_{RR}[k,m]}\vec{X}_L[k,m]$$

$$\vec{D}_R[k,m]=\frac{r_{LR}[k,m]}{r_{LL}[k,m]}\vec{X}_R[k,m]$$

where the divisions are protected against singularities by threshold testing: if $r_{RR}[k,m]$ is less than a predetermined or potentially adaptive threshold, then the assignment $\vec{D}_L[k,m]=\vec{X}_L[k,m]$ is made; for small values of $r_{RR}[k,m]$, the right channel has negligible energy, so the left channel can be reasonably considered to be composed only of primary components (for example, a hard-panned source), so all of the left-channel content is assigned to the projection result $\vec{D}_L[k,m]$, which is the nominal primary component in the various embodiments of the cross-channel projection primary-ambience decomposition method, An analogous threshold test is carried out on $r_{LL}[k,m]$. In short, if either channel is deemed negligible (for a given k and m) according to the threshold test, the signal (at that m and k) is deemed to be nominally primary. After the cross-channel projections are computed, the subtraction blocks 209 and 211 then respectively compute the projection residuals as $$\vec{E}_L[k,m]=\vec{X}_L[k,m]-\vec{D}_L[k,m]$$

$$\vec{E}_R[k,m]=\vec{X}_R[k,m]-\vec{D}_R[k,m].$$

By construction, the projection $\vec{D}_L$ and the residual $\vec{E}_L$ are orthogonal, and likewise for $\vec{D}_R$ and $\vec{E}_R$. The subtraction blocks 209 and 211 thus yield the signal decompositions $$\vec{X}_L[k,m]=\vec{D}_L[k,m]+\vec{E}_L[k,m]$$

$$\vec{X}_R[k,m]=\vec{D}_R[k,m]+\vec{E}_R[k,m]$$

where $\vec{D}_L$ and $\vec{D}_R$ are the nominal primary components in a first embodiment of the cross-channel projection method, and $\vec{E}_L$ and $\vec{E}_R$ are the corresponding nominal ambience components. The components $\vec{D}_L$ (line 215), $\vec{D}_R$ (line 217), $\vec{E}_L$ (line 219), and $\vec{E}_R$ (line 221) are provided as inputs to the mixer block 213, shown as a dashed box in FIG. 2. The mixer block is configured with gains to combine the input components to form modified primary and ambient components according to the following equations:

$$\breve{A}_L[k,m]=\alpha_{LD}\breve{D}_L[k,m]+\alpha_{LE}\breve{E}_L[k,m]$$

$$\breve{P}_L[k,m]=\rho_{LD}\breve{D}_L[k,m]+\rho_{LE}\breve{E}_L[k,m]$$

$$\breve{A}_R[k,m]=\alpha_{RD}\breve{D}_R[k,m]+\alpha_{RE}\breve{E}_R[k,m]$$

$$\breve{P}_R[k,m]=\rho_{RD}\breve{D}_R[k,m]+\rho_{RE}\breve{E}_R[k,m].$$

The component vectors $\breve{A}_L$, $\breve{P}_L$, $\breve{P}_R$, and $\breve{A}_R$ are output by the mixer block 213 on lines 221, 223, 225, and 227, respectively. In the diagram of FIG. 2 the vector notation is omitted from the output without loss of generality. Those skilled in the arts will recognize that there is a correspondence between signals and vectors and that the vector notation is not required for specificity. In the above equations, the gains could be dependent on the frequency index k and/or the time index m although such dependency is omitted from the notation The various embodiments of the invention that incorporate cross-channel projection correspond to different options for the gains in the mixer block 213 as described in the following. Those skilled in the art will recognize that other combinations of the signals on lines 215, 217, 219, and 221 are possible beyond those illustrated in block 213, for instance combination of the components across the L and R channels. Several combinations are specified in accordance with embodiments of the present invention, but the invention is not limited in this regard and other combinations beyond those illustrated in FIG. 2 are within the scope of the invention.

In a first embodiment of the invention incorporating cross-channel projection, the gains are chosen to be $\alpha_{LD}=0$ $\rho_{LD}=1$
$\alpha_{LE}=1$ $\rho_{LE}=0$
$\alpha_{RD}=0$ $\rho_{RD}=1$
$\alpha_{RE}=1$ $\rho_{RE}=0$ such that the primary and ambient components output by block 213 correspond exactly to those provided by block 207 and subtraction units 209 and 211; specifically, $$\breve{A}_L[k,m]=\breve{E}_L[k,m]$$

$$\breve{P}_L[k,m]=\breve{D}_L[k,m]$$

$$\breve{A}_R[k,m]=\breve{E}_R[k,m]$$

$$\breve{P}_R[k,m]=\breve{D}_R[k,m].$$

Those skilled in the relevant art will recognize that this embodiment can be equivalently implemented without the mixer block 213.

Figure 3:
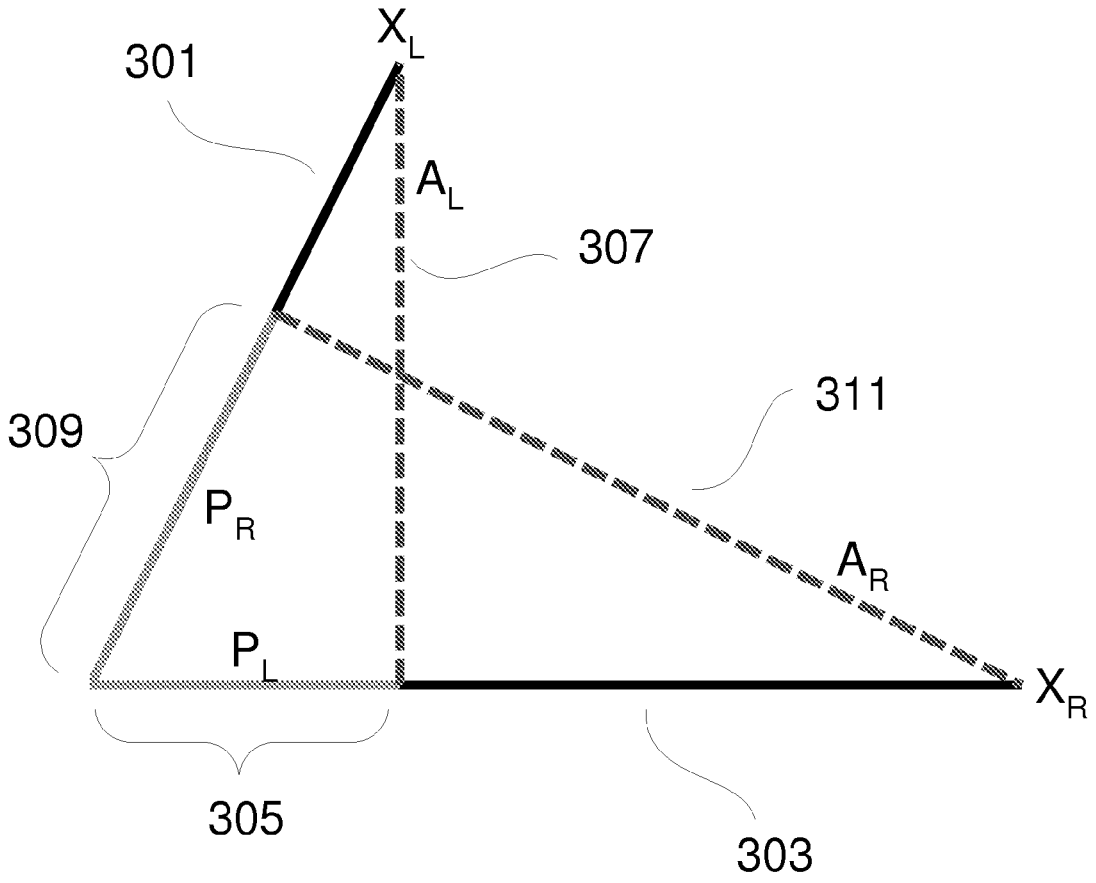
FIG. 3 is a diagram illustrating vector-space decomposition in accordance with embodiments of the present invention.

FIG. 3 is a vector diagram depicting the primary-ambient decomposition derived in the first embodiment incorporating cross-channel projection. Input vector 301 (labeled $X_L$) is decomposed into primary component 305 (labeled $P_L$) and ambient component 307 (drawn with a dashed line and labeled $A_L$). The diagram demonstrates that the component vectors 305 and 307 derived via cross-channel projection are orthogonal (perpendicular) and that their vector sum is equal to the original input vector 301. Likewise, input vector 303 (labeled $X_R$) is decomposed into primary component 309 (labeled $P_R$) and ambient component 311 (drawn with a dashed line and labeled $A_R$).

In the first embodiment, the correlation coefficient of the computed primary components is equivalent to that of the original input vectors. In accordance with second through fourth embodiments incorporating cross-channel projection, the correlation coefficient between the primary components is increased by adjusting the gains in the mixer block 213 so as to increase the cross-correlation between the primary components with respect to those of the first embodiment. This can be achieved by judicious selection of gain parameters $\beta_L$ and $\beta_R$, both between 0 and 1 in the preferred embodiments, and assignment of the gains in the mixer block 213 according to $\alpha_{LD}=0$ $\rho_{LD}=1$
$\alpha_{LE}=\beta_L$ $\rho_{LE}=1-\beta_L$
$\alpha_{RD}=0$ $\rho_{RD}=1$
$\alpha_{RE}=\beta_R$ $\rho_{RE}=1-\beta_R$ such that the primary and ambient component outputs of the mixer block 213 are given by $$\breve{A}_L[k,m]=\beta_L\breve{E}_L[k,m]$$

$$\breve{P}_L[k,m]=\breve{D}_L[k,m]+(1-\beta_L)\breve{E}_L[k,m]$$

$$\breve{A}_R[k,m]=\beta_R\breve{E}_R[k,m]$$

$$\breve{P}_R[k,m]=\breve{D}_R[k,m]+(1-\beta_R)\breve{E}_R[k,m].$$

Figure 4:
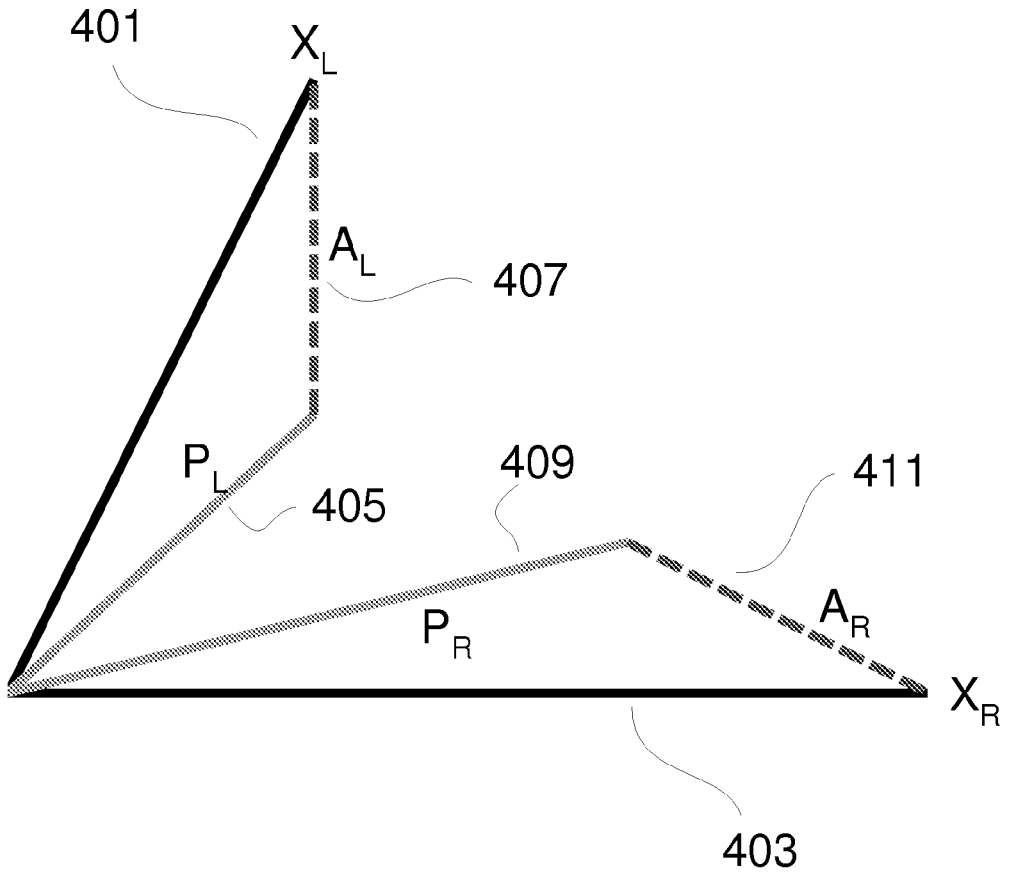
FIG. 4 is a diagram illustrating vector-space decomposition in accordance with embodiments of the present invention.

With $\beta_L$ and $\beta_R$ chosen to both be between 0 and 1, the resulting primary component vectors are more correlated than in the first embodiments. FIG. 4 is a vector diagram illustrating the use of such adjustment gains to increase the correlation coefficient between the primary components with respect to the first embodiment depicted in FIG. 3. Increasing the correlation coefficient between the primary components (such that its magnitude is closer to one) is equivalent to bringing the primary vectors closer to being collinear in vector space. This process can be thought of as "focusing" the primary components. For input signal vectors 401 and 403 corresponding to input signal vectors 301 and 303 in FIG. 3, the primary component vectors 405 and 409 are closer to being collinear than the primary component vectors 305 and 309 in FIG. 3. The primary component vectors thus have a higher correlation coefficient in the second through fourth embodiments than in the first embodiment.

Those skilled in the relevant arts will recognize that a variety of methods are possible for selecting the gain parameters $\beta_L$ and $\beta_R$. For the purposes of specification, we disclose three embodiments although the invention should not be viewed as limited in this regard. Furthermore, for the second through fourth embodiments, we describe and illustrate selection of the gain parameters $\beta_L$ and $\beta_R$ so as to make the primary components entirely collinear, although the invention is not limited in this regard and embodiments wherein the computed primary components are not entirely collinear are within the scope of the invention. Indeed, the scope of the invention includes without limitation any and all primary-ambient decomposition methods whereby an initial primary-ambient decomposition (such as that provided by the first embodiment) is rebalanced so as to achieve a desired property such as increased correlation between the primary components with respect to the initial decomposition.

In accordance with second through fourth embodiments, and furthermore in accordance with variations of these embodiments wherein the resulting primary vectors are fully correlated and collinear in signal space, the gain parameters are selected so as to satisfy the following relationship:

$$\beta_L = \frac{1-\beta_R}{1+\beta_R(|\phi_{LR}|^2-1)}$$

where $\phi_{LR}$ denotes the correlation coefficient between the original input signal vectors $\vec{X}_L[k,m]$ and $\vec{X}_R[k,m]$. The correlation coefficient $\phi_{LR}$ as well as the gain parameters $\beta_L$ and $\beta_R$ are in general functions of frequency k and time m, although these indices are not included in the notation for the sake of simplifying the equations.

According to a second embodiment, the gain parameters $\beta_L$ and $\beta_R$ are selected to be equal. In the preferred variation wherein the resulting primary components are fully correlated, the gains are selected according to $$\beta_L = \beta_R = \frac{1}{|\phi_{LR}|+1}.$$

Figure 5:
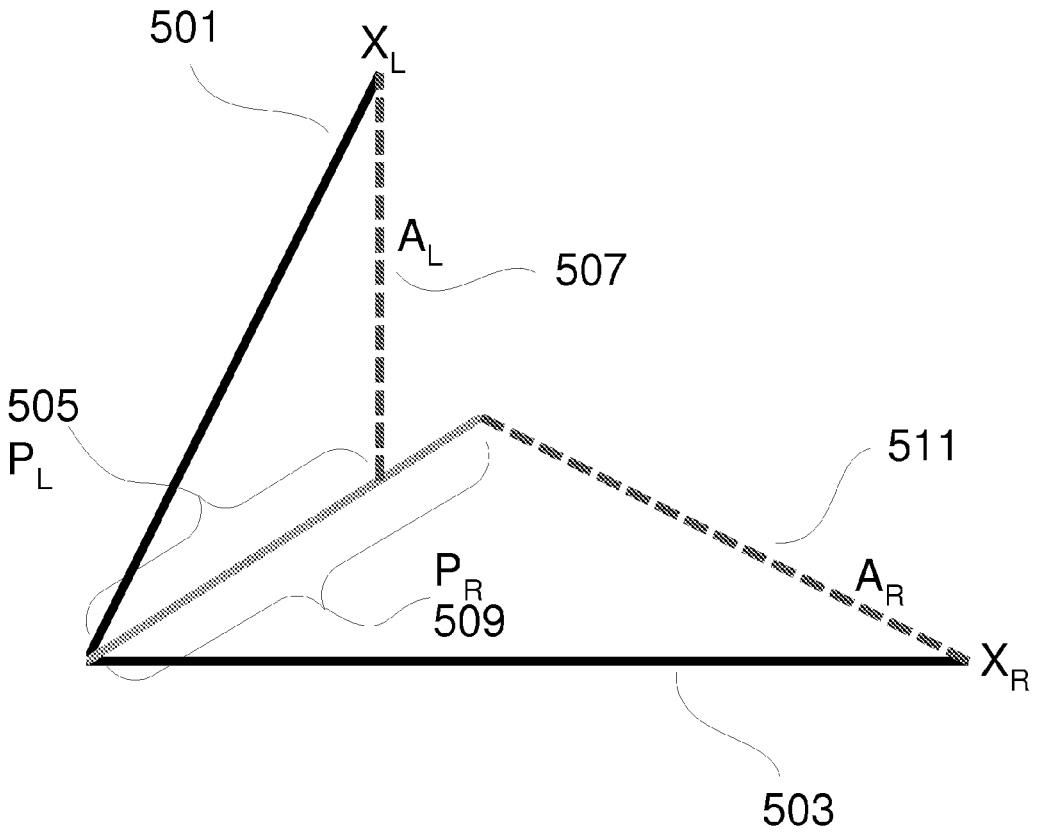
FIG. 5 is a diagram illustrating vector-space decomposition in accordance with one embodiment of the present invention.

FIG. 5 is a vector diagram illustrating this embodiment. Signal vector 501 is decomposed into primary component 505 and ambience component 507, and signal vector 503 is decomposed into primary component 509 and ambience component 511. As the diagram illustrates, the ambience component 507 is orthogonal to channel 503, and the ambience component 511 is orthogonal to channel 501. Furthermore, the primary components 505 and 509 are collinear.

Figure 6:
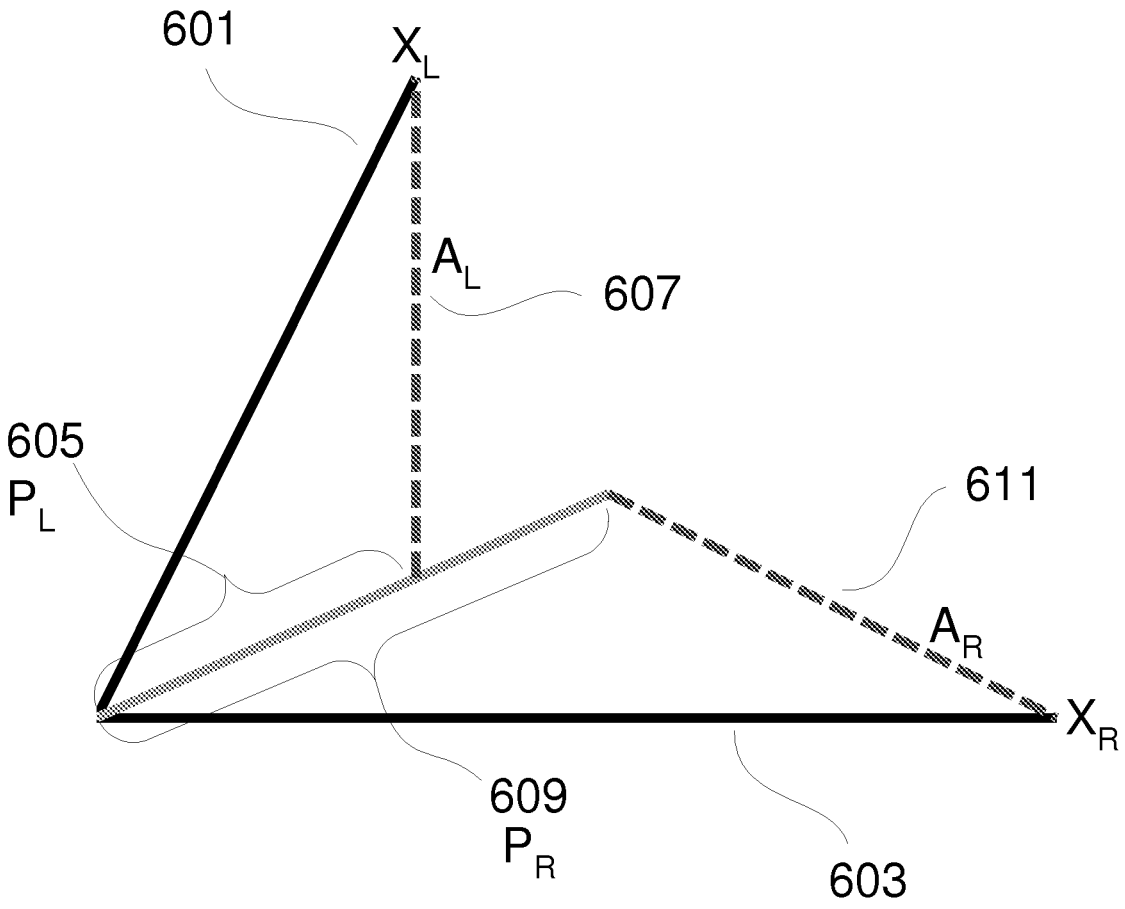
FIG. 6 is a diagram illustrating vector-space decomposition in accordance with one embodiment of the present invention.

According to a third embodiment, the gain parameters $\beta_L$ and $\beta_R$ are selected such that the resulting ambience components have equal energy in the L and R channels. In other words, the ambience is not panned, which is consistent with the typical original ambience in stereo recordings. FIG. 6 is a vector diagram illustrating this embodiment. Signal vector 601 is decomposed into primary component 605 and ambience component 607, and signal vector 603 is decomposed into primary component 609 and ambience component 611. As the diagram illustrates, the ambience component 607 is orthogonal to channel 603, and the ambience component 611 is orthogonal to channel 601. Furthermore, the primary components 605 and 609 are collinear.

According to a fourth embodiment, the gain parameters $\beta_L$ and $\beta_R$ are selected such that the resulting ambience components have a minimum total energy. The assumption in this embodiment is that the majority of the signal content can be well modeled with a panned primary vector by minimizing the total energy not captured by the primary components.

Primary-Ambient Decomposition by Principal Component Analysis

According to a fifth embodiment of the present invention, the primary-ambient decomposition is determined via principal components analysis. In this embodiment, PCA is used to find the primary vector which best explains the multichannel input signal content, i.e. which represents the multichannel content with the least total residual energy across all channels (which corresponds to the ambience in this approach). The primary vector determined via PCA is common to all of the channels. The primary components for the various input channels are determined via orthogonal projection onto this common primary vector; the primary components for the various channels are thereby collinear (fully correlated). In the following, a PCA-based algorithm for primary-ambient decomposition of multichannel audio is given and a closed-form solution for the two-channel case is developed.

Figure 7:
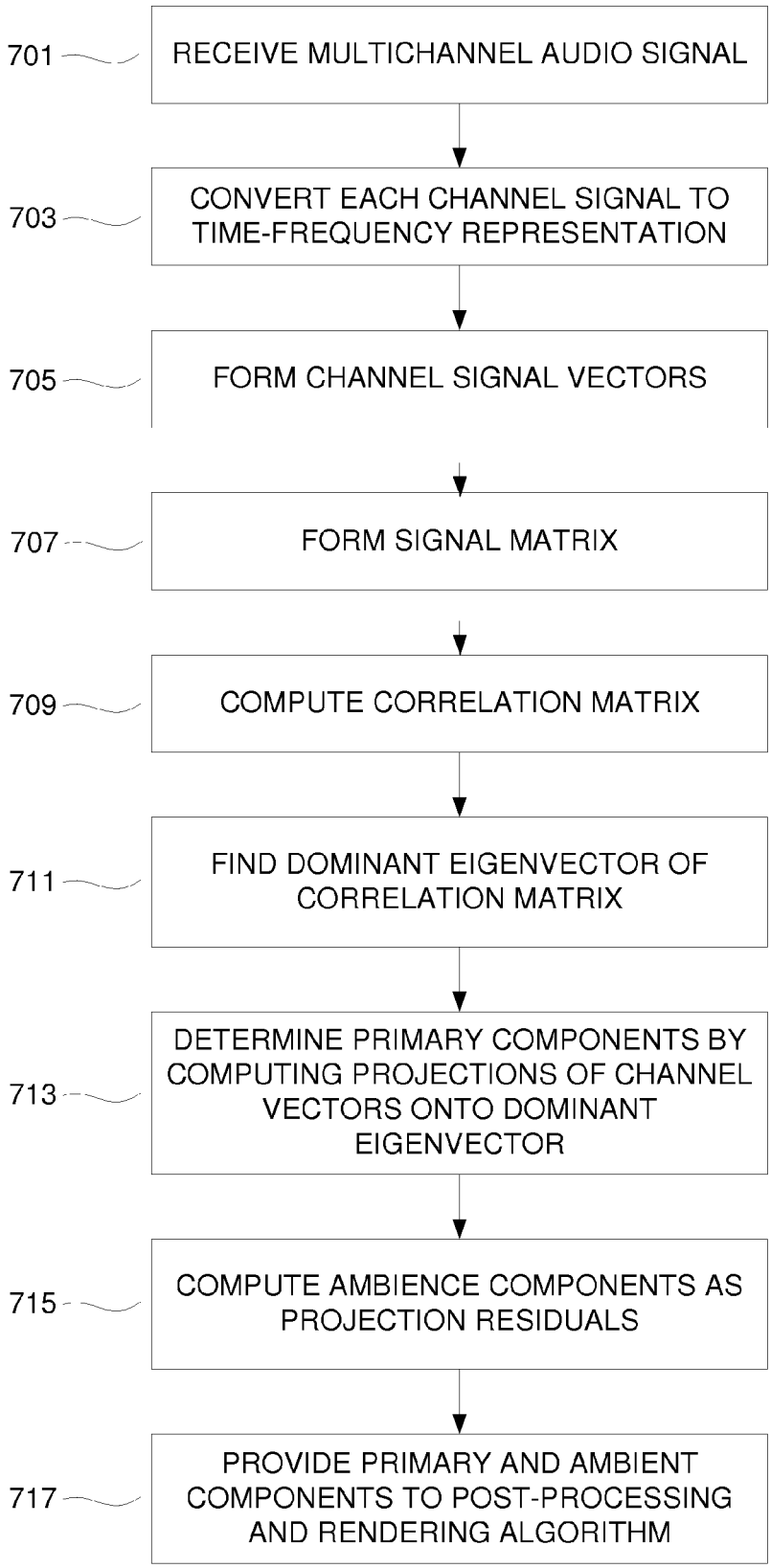
FIG. 7 is a flow chart of a method for primary-ambient decomposition of multichannel audio in accordance with one embodiment of the present invention.

FIG. 7 is a flow chart describing the primary-ambient decomposition of a multichannel audio signal using principal components analysis. The process begins in step 701 where a multichannel audio signal is received. In step 703, the audio channel signals $x_i[n]$ are converted to a time-frequency representation $X_i[k,m]$, e.g. using the STFT. In step 705, the time-frequency channel signals are assembled into channel vectors (by concatenating successive samples); in step 707, a signal matrix whose columns are the channel vectors is formed. The signal correlation matrix is computed in step 709; denoting the signal matrix by X, the correlation matrix is found as $R=XX^H$ where H denotes the conjugate transpose. In step 711, the largest eigenvalue $\lambda_p$ and the corresponding dominant eigenvector $\vec{v}_p$ are determined. This dominant eigenvector corresponds to the "principal component", and it can also be referred to as the "principal eigenvector". In step 713, the orthogonal projection of each channel vector onto the eigenvector $\vec{v}_p$ is computed and identified as the primary component for that channel. In step 715, the ambience component for each channel is computed by subtracting the primary component vector determined in 713 from the original channel vector. Those skilled in the arts will recognize that in some implementations the primary component vector and the ambience component vector can be determined at each sample time m such that explicit formation of primary and ambient component vectors is not required in the implementation; such implementations are within the scope of the invention. In step 717, the primary and ambient components are provided to a post-processing and rendering algorithm which includes a conversion of the frequency-domain primary and ambient components into time-domain signals.

Those skilled in the arts will recognize that step 711 can be carried out by computing a full eigendecomposition and then selecting the largest eigenvalue and corresponding eigenvector or by using a computation method wherein only the dominant eigenvector is determined. For instance, the dominant eigenvector can be approximated effectively and efficiently by selecting an initial vector $\vec{v}_0$ and iterating the following steps:

$$\vec{v}_0 \leftarrow R\,\vec{v}_0$$

$$\vec{v}_0 \leftarrow \frac{\vec{v}_0}{\|\vec{v}_0\|}$$

As these steps are repeated, the vector $\vec{v}_0$ converges to the dominant eigenvector (the one with the largest eigenvalue), with a faster convergence if the eigenvalue spread of the correlation matrix R is large. This efficient approach is viable since only the dominant eigenvector is needed in primary-ambient decomposition algorithm, and such an approach is preferable in implementations where computational resources are limited since determining a full explicit eigendecomposition can be computationally costly. A practical starting value for $\vec{v}_0$ is the column of X with the largest norm, since that will dominate the principal component computation. Those skilled in the relevant arts will recognize that other methods for computing the principal component could be used. The current invention is not limited to the methods disclosed here; other methods for determining the dominant eigenvector are within the scope of the invention.

Figure 8:
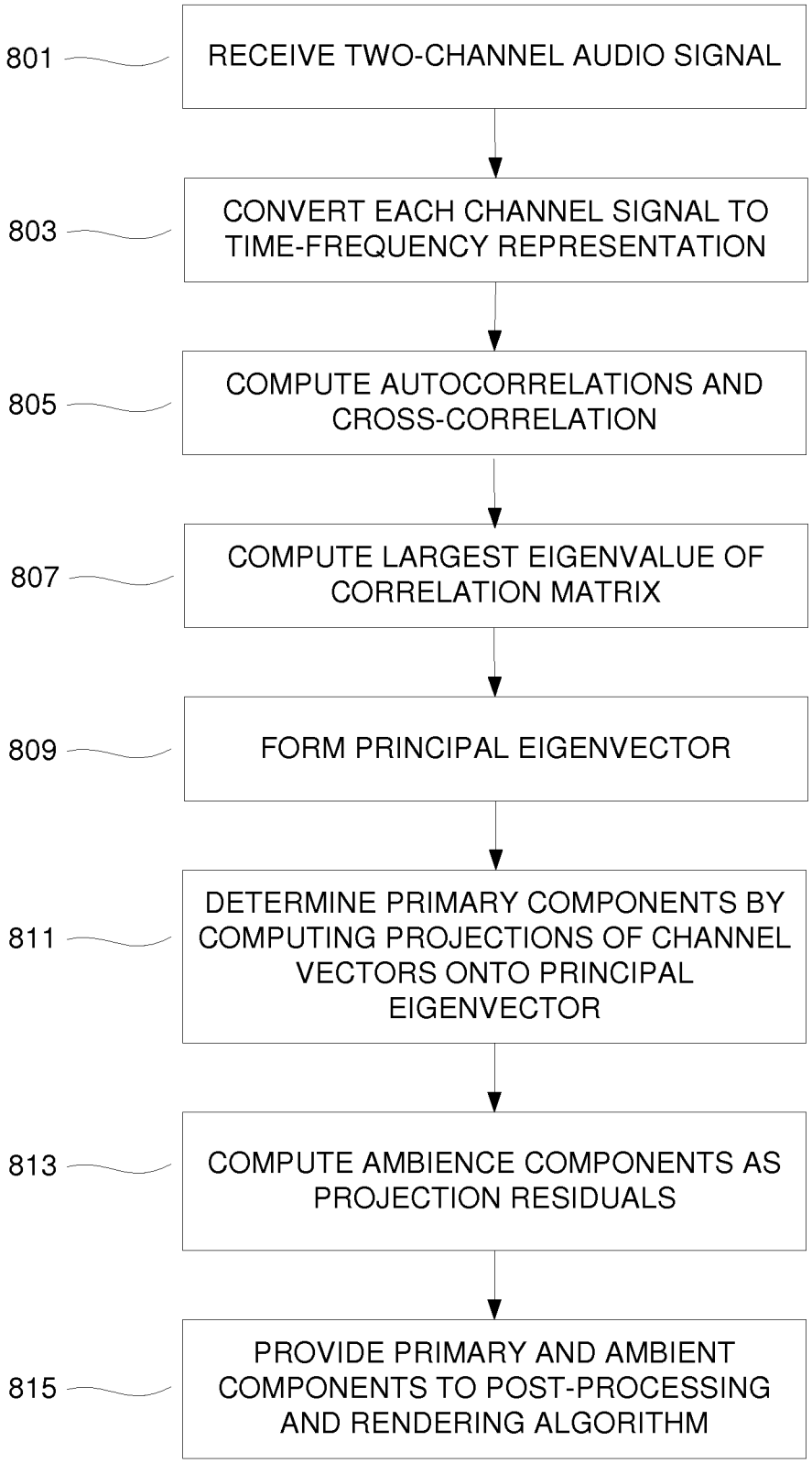
FIG. 8 is a flow chart of a method for primary-ambient decomposition of two-channel audio in accordance with one embodiment of the present invention.

For the two-channel case, the current invention provides a simple closed-form solution such that explicit eigendecomposition or iterative eigenvector approximation methods are not required. FIG. 8 provides a flow chart for primary-ambient decomposition of two-channel audio signals using principal components analysis. The process begins in step 801 where a two-channel audio signal is received. In step 803, the audio channel signals are converted to a time-frequency representations $X_L[k,m]$ and $X_R[k,m]$, e.g. using the STFT. In step 805, the cross-correlation $r_{LR}[k,m]$ and auto-correlations $r_{LL}[k,m]$ and $r_{RR}[k,m]$ are computed, in a preferred embodiment by the recursive inner product computation method described earlier. In step 807, the largest eigenvalue of the signal correlation matrix is computed according to $$\lambda[k,m] = \frac{1}{2}(r_{LL}[k,m] + r_{RR}[k,m]) + \frac{1}{2}[(r_{LL}[k,m] - r_{RR}[k,m])^2 + 4|r_{LR}[k,m]|^2]^{\frac{1}{2}}.$$

In this method, the computation of the largest eigenvalue of the correlation matrix can be carried out directly using the correlation quantities computed in step 805 and does not require explicit formation of channel vectors, a signal matrix, or a correlation matrix. In step 809, the principal component vector is formed according to $$\vec{v}[k,m] = r_{LR}[k,m]\vec{X}_R[k,m] + (\lambda[k,m] - r_{LL}[k,m])\vec{X}_R[k,m].$$

In some embodiments, this principal component vector may be normalized in step 809 although this is not explicitly required. In step 811, the primary components are determined by projecting the input signal vectors on the principal eigenvector according to $$\vec{P}_L[k,m] = \left(\frac{r_{vL}[k,m]}{r_{vv}[k,m]}\right)\vec{v}[k,m]$$

$$\vec{P}_R[k,m] = \left(\frac{r_{vR}[k,m]}{r_{vv}[k,m]}\right)\vec{v}[k,m]$$

where $$r_{vL}[k,m] = \vec{v}[k,m]^H \vec{X}_L[k,m]$$

$$r_{vR}[k,m] = \vec{v}[k,m]^H \vec{X}_R[k,m]$$

$$r_{vv}[k,m] = \vec{v}[k,m]^H \vec{v}[k,m]$$

and where the division by $r_{vv}[k,m]$ is protected against singularities. If $r_{vv}[k,m]$ is below a certain threshold, the primary component (for that k and m) is assigned a zero value. In step 813, the ambience components are computed by subtracting the primary components derived in step 811 from the original signals according to:

$$\vec{A}_L[k,m] = \vec{X}_L[k,m] - \vec{P}_L[k,m]$$

$$\vec{A}_R[k,m] = \vec{X}_R[k,m] - \vec{P}_R[k,m].$$

Those skilled in the arts will recognize that in some implementations the primary component vector and the ambience component vector can be determined at each sample time m such that explicit formation of primary and ambient component vectors is not required in the implementation; such sample-by-sample implementations are within the scope of the invention. In step 815, the primary and ambient components are provided to a post-processing and rendering algorithm which includes a conversion of the frequency-domain primary and ambient components into time-domain signals.

Those skilled in the arts will understand that the projection of the signal onto the principal component in step 811 could be implemented in a number of ways, for instance by expressing the autocorrelation $r_{vv}$ in a closed form based on other quantities. The current invention is not limited with regard to the manner of computation of the projection of the signals onto the primary component; any computational method to derive this projection is within the scope of the invention. In some implementations it may be preferable to use the approach described above for the sake of computational efficiency.

Figure 9:
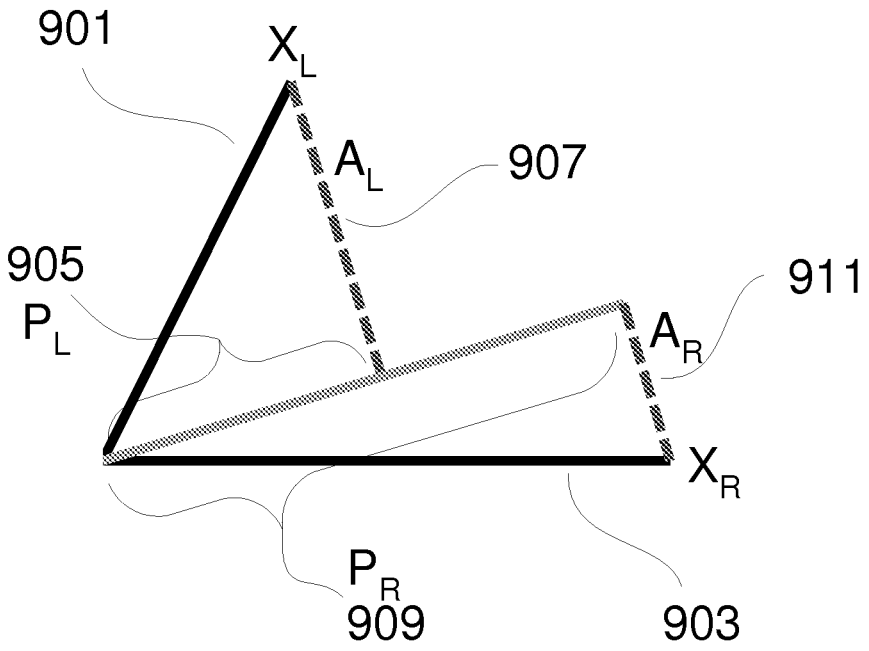
FIG. 9 is a diagram illustrating vector-space decomposition in accordance with one embodiment of the present invention.

FIG. 9 is a vector diagram illustrating primary-ambient decomposition based on principal components analysis. Signal vector 901 is decomposed into primary component 905 and ambience component 907, and signal vector 903 is decomposed into primary component 909 and ambience component 911. As the diagram illustrates, the ambience component 907 is orthogonal to the primary component 905, and the ambience component 911 is orthogonal to the primary component 909. Furthermore, the primary components 905 and 909 are collinear.

Post-Processing for Improved Decomposition, Artifact Reduction, and Enhancement

In accordance with further embodiments of the present invention, the primary-ambient decomposition is post-processed so as to improve the fidelity of the decomposition, reduce audible artifacts in the primary and/or ambient components, or provide other enhancements such as suppression or accentuation of ambience components. These post-processing operations are described in the following.

Ambience Component Enhancement.

In some applications, it may be desirable to increase the level of the ambience components in an audio signal while maintaining the level of the primary components. The primary-ambient decompositions enabled by the present invention allow for such modifications.

Figure 10:
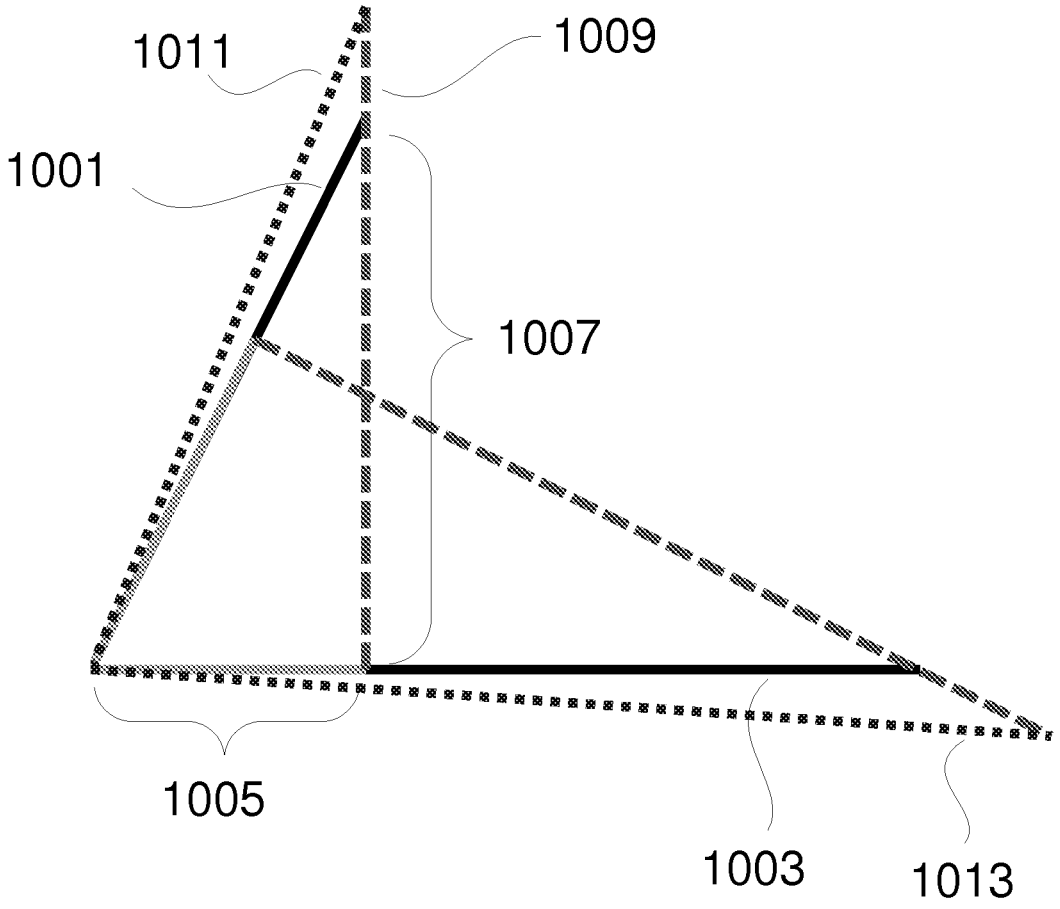
FIG. 10 is a diagram illustrating ambience enhancement based on vector-space decomposition in accordance with one embodiment of the present invention.

FIG. 10 is a diagram depicting enhancement of ambience components carried out on a primary-ambient decomposition derived via cross-channel projection in accordance with one embodiment of the present invention. The input signal 1001 is decomposed into primary component 1005 and ambience component 1007 via cross-channel projection (onto input signal 1003). The ambience component 1007 is boosted (increased in length) to yield modified ambience component 1009 (which includes the indicated segment 1007). The modified ambience component 1009 is added to the unmodified primary component (1005) to derive the ambience-enhanced output signal 1011 (shown with a dotted line). An analogous operation is carried out on the input signal 1003 to yield the ambience-enhanced output signal 1013.

Figure 11:
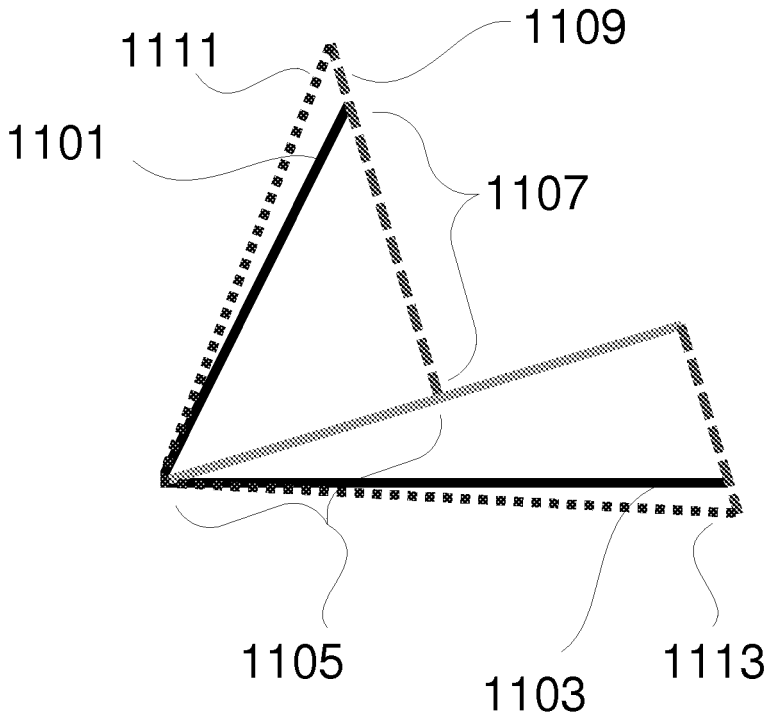
FIG. 11 is a diagram illustrating ambience enhancement based on vector-space decomposition in accordance with one embodiment of the present invention.

FIG. 11 is a diagram depicting enhancement of ambience components carried out on a primary-ambient decomposition derived via principal component analysis in accordance with one embodiment of the present invention. The input signal 1101 is decomposed into primary component 1105 and ambience component 1107 via principal component analysis (in conjunction with input signal 1103). The ambience component 1107 is boosted (increased in length) to yield modified ambience component 1109 (which includes the indicated segment 1107). The modified ambience component 1109 is added to the unmodified primary component (1105) to derive the ambience-enhanced output signal 1111 (shown with a dotted line). An analogous operation is carried out on the input signal 1003 to yield the ambience-enhanced output signal 1113.

With the guidance provided by this specification, those skilled in the arts will recognize that different embodiments of the invention can be derived from the application of such an ambience enhancement process to any of the primary-ambient decompositions enabled by the present invention.

Ambience Component Suppression.

In some applications, it may be desirable to decrease the level of the ambience components in an audio signal while maintaining the level of the primary components. The primary-ambient decompositions enabled by the present invention allow for such modifications.

Figure 12:
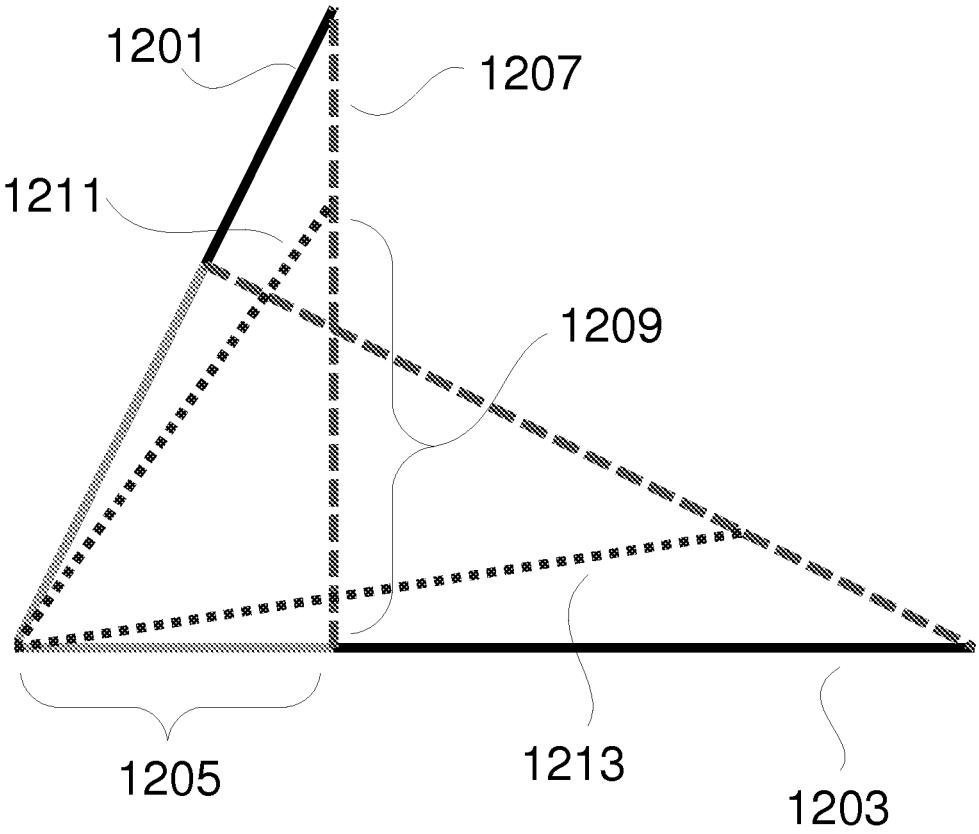
FIG. 12 is a diagram illustrating ambience suppression based on vector-space decomposition in accordance with one embodiment of the present invention.

FIG. 12 is a diagram depicting suppression of ambience components carried out on a primary-ambient decomposition derived via cross-channel projection in accordance with one embodiment of the present invention. The input signal 1201 is decomposed into primary component 1205 and ambience component 1207 via cross-channel projection (onto input signal 1203). The ambience component 1207 (which includes the indicated segment 1209) is attenuated (decreased in length) to yield modified ambience component 1209. The modified ambience component 1209 is added to the unmodified primary component (1205) to derive the ambience-suppressed output signal 1211 (shown with a dotted line). An analogous operation is carried out on the input signal 1203 to yield the ambience-suppressed output signal 1213.

Figure 13:
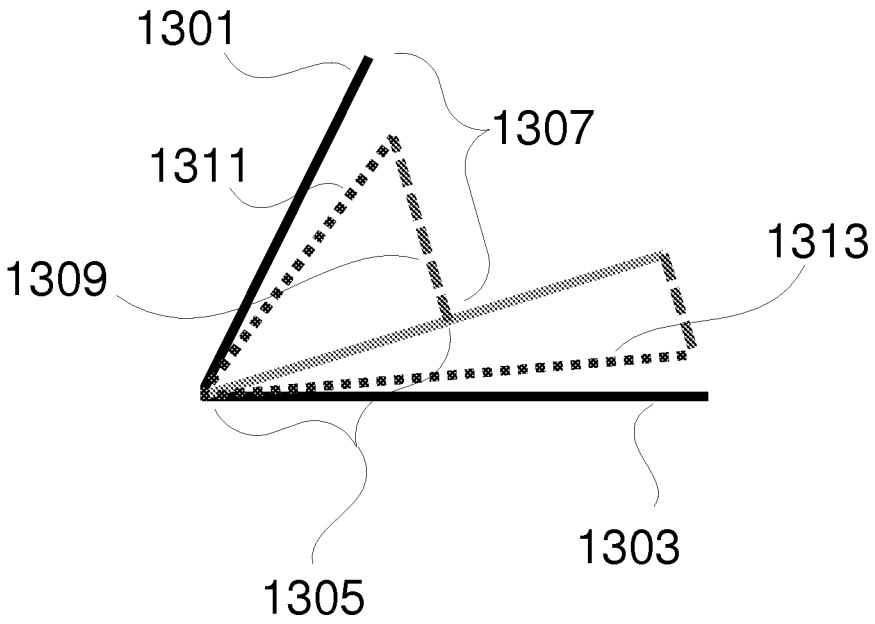
FIG. 13 is a diagram illustrating ambience suppression based on vector-space decomposition in accordance with one embodiment of the present invention

FIG. 13 is a diagram depicting suppression of ambience components carried out on a primary-ambient decomposition derived via principal component analysis in accordance with one embodiment of the present invention. The input signal 1301 is decomposed into primary component 1305 and ambience component 1307 via principal component analysis (in conjunction with input signal 1303). (The vector for ambience component 1307 is not fully drawn in the diagram for the sake of clarity.) The ambience component 1307 is attenuated (decreased in length) to yield modified ambience component 1309. The modified ambience component 1309 is added to the unmodified primary component (1305) to derive the ambience-suppressed output signal 1311 (shown with a dotted line). An analogous operation is carried out on the input signal 1303 to yield the ambience-suppressed output signal 1313.

With the guidance provided by this specification, those skilled in the arts will recognize that different embodiments of the invention can be derived from the application of such an ambience suppression process to any of the primary-ambient decompositions enabled by the present invention.

Primary Component Enhancement.

In some applications, it may be desirable to increase the level of the primary components in an audio signal while maintaining the level of the ambience components. The primary-ambient decompositions enabled by the present invention allow for such modifications. Analogously to the ambience enhancement example described with reference to FIGS. 10 and 11, in this variation the primary component from the primary-ambient decomposition is boosted and added to the unmodified ambience component to derive a primary-enhanced signal. With the guidance provided by this specification, those skilled in the arts will recognize that different embodiments of the invention can be derived from the application of such a primary enhancement process to any of the primary-ambient decompositions enabled by the present invention.

Primary Component Suppression.

In some applications, it may be desirable to decrease the level of the primary components in an audio signal while maintaining the level of the ambience components. The primary-ambient decompositions enabled by the present invention allow for such modifications. Analogously to the ambience suppression example described with reference to FIGS. 12 and 13, in this variation the primary component from the primary-ambient decomposition is attenuated and added to the unmodified ambience component to derive a primary-suppressed signal. With the guidance provided by this specification, those skilled in the arts will recognize that different embodiments of the invention can be derived from the application of such a primary suppression process to any of the primary-ambient decompositions enabled by the present invention.

Component Mixing.

To mitigate artifacts which may occur in the primary-ambient decompositions enabled in the present invention, it is useful to add a small amount of the original signal to the extracted components such that the artifacts are rendered inaudible. Given an initial primary-ambient decomposition of a channel signals, addition of a scaled version of the input channel signal to either the ambience or primary component is arithmetically equivalent to forming a linear combination of the initial ambience and primary components.

Those skilled in the arts will recognize that ambience component enhancement, ambience component suppression, primary component enhancement, primary component suppression, or cross-component mixing could be implemented in the mixer block 213 of FIG. 2 in conjunction with embodiments incorporating cross-channel projection to determine the primary-ambient decomposition, all being within the scope of the different embodiments of the present invention. Those skilled in the arts will further understand that a mixer similar to that of block 213 could be applied to a primary-ambient decomposition derived via PCA to realize these post-processing operations in the context of PCA-based embodiments of the present invention.

Reprojection.

In a further post-processing operation, the original signal is projected onto the extracted primary component to derive an enhanced primary component, and the ambient component is recomputed as the projection residual. The operation thus derives an orthogonal primary-ambient decomposition, and is very effective for reducing artifacts and improving the naturalness of the primary and ambient components. Due to the orthogonality properties of the PCA approach, this post-processing operation has no effect on the PCA primary-ambient decomposition unless a different time constant is used in the inner product calculations for the reprojection post-processing; it is thus primarily useful to make the focused cross-projection decomposition of the second through fourth embodiments of the present invention more like the PCA decomposition of the fifth embodiment. In an alternate reprojection approach, the primary estimate is projected back onto the original signal for each channel. A correlation analysis shows that this reduces the leakage of primary components into the ambience component.

Allpass Filtering.

An allpass filter network can be used to further decorrelate the extracted ambience and/or to synthesize additional decorrelated ambience signals for multichannel upmix algorithms. This is helpful to enhance the sense of spaciousness and envelopment in the rendering. In upmix applications, the requisite number of ambience channels can be generated by using a bank of mutually orthogonal allpass filters as will be understood by those of skill in the relevant arts.

Post-Filtering.

Post-filtering can be used to further enhance the primary-ambient separation achieved by the primary-ambient decomposition methods disclosed herein. For each channel, the ambience spectrum is derived from the estimated ambience, and its inverse is applied as a weight to the primary spectrum. This post-filtering suppression is effective in some cases to improve primary-ambient separation, in other words to suppress the leakage of primary components into the ambience.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for processing a multichannel audio signal to determine primary and ambient components of the signal, the method comprising:

converting each channel of the multichannel audio signal to corresponding subband vectors, wherein the vectors comprise a time sequence or history of the channel signal's behavior in corresponding subbands;

determining, using at least one processor, a primary component unit vector for each subband by a principal component analysis; and determining primary component vectors for each audio channel in each subband by projecting the channel subband vector onto the primary component unit vector; and determining the ambience component vector for each channel in each frequency subband as the projection residual; and generating the primary and ambience components from the respective primary and ambience component vectors.

2. The method as recited in claim 1 further comprising computing a correlation matrix corresponding to the left and right channel subband data;

determining at least a dominant eigenvalue and corresponding eigenvector for the correlation matrix; and wherein the primary component vector is determined at least in part from the dominant eigenvalue or the corresponding eigenvector.

3. The method as recited in claim 1 further comprising performing an allpass filtering operation on the extracted ambient signal for distributing the processed signals to the surround speakers in a multichannel rendering.

4. A method for determining primary and ambient components of a signal, the method comprising:

converting for each subband left and right channels of the audio signal to corresponding frequency-domain vectors; and decomposing using at least one processor the left and right channel vectors into ambient and primary components by cross-channel orthogonal projection for determining the ambience in the right channel as orthogonal to the left channel vector and the ambience in the left channel as orthogonal to the right channel vector.

5. The method as recited in claim 4 wherein the primary component for at least one channel is determined by the residual in the signal after the ambience is determined.

6. The method as recited in claim 4 wherein the ambience components for the respective left and right channels are subsequently scaled with equal weights and the primary components for the left and right channels are determined by the difference between the respective channel signal and the corresponding rescaled ambience.

7. The method as recited in claim 4 wherein the magnitudes of the ambient components for the left and right channels are scaled to be equal to each other and the primary components are determined by the difference between the respective channel signal and the corresponding rescaled ambience.

8. The method as recited in claim 4 wherein the magnitudes of the ambient components for the left and right channels are scaled such that the ambient signals for the respective channels contain equal energy and the primary components are determined by the difference between the respective channel signal and the corresponding rescaled ambience.

9. The method as recited in claim 4 further comprising performing an allpass filtering operation on the extracted ambient signal for distributing the processed signals to the surround speakers in a multichannel rendering.

10. The method as recited in claim 4 further comprising extracting a center channel from the derived primary component(s).

11. A method for determining primary and ambient components of at least a two channel signal having respective channels $x_L$ and $x_R$, the method comprising:

determining vectors $v_L$ and $v_R$, orthogonally projecting using at least one processor the originals $x_L$ and $x_R$ onto those respective vectors to determine the primary components of the original signal; and determining the ambience as the projection residual.

12. The method as recited in claim 11 wherein $v_L$ and $v_R$ comprise a common vector for the left and right channels and the common vector is determined as the principal eigenvector determined by principal component analysis.

13. The method as recited in claim 11 wherein $v_L$ is equal to or a scaled version of $x_R$ and $v_R$ is equal to or a scaled version of $x_L$ and $v_L$ and $v_R$ are determined by cross-channel projection.

14. A system for processing a multichannel audio signal having at least two channels to determine primary and ambient components of the signal, comprising:

a conversion module for converting each channel of the multichannel audio signal to corresponding subband vectors, wherein the vectors comprise a time sequence or history of the channel signal's behavior in corresponding subbands;

at least one processor configured to determine a primary component unit vector for each subband by a principal component analysis; to determine primary component vectors for each audio channel in each subband by projecting the channel subband vector onto the primary component unit vector; and to determine the ambience component vector for each channel in each frequency subband as the projection residual; and a module for generating the primary and ambience components from the respective primary and ambience component vectors.

* * * * *